US007549229B2

(12) United States Patent
Aoyama et al.

(10) Patent No.: US 7,549,229 B2
(45) Date of Patent: Jun. 23, 2009

(54) PORTABLE CIRCULAR SAW

(75) Inventors: Shuji Aoyama, Anjo (JP); Toshiyuki Kani, Anjo (JP)

(73) Assignee: Makita Corporation, Anjo (JP)

( * ) Notice: Subject to any disclaimer, the term of this patent is extended or adjusted under 35 U.S.C. 154(b) by 204 days.

(21) Appl. No.: 11/474,329

(22) Filed: Jun. 26, 2006

(65) Prior Publication Data

US 2006/0288590 A1 Dec. 28, 2006

(30) Foreign Application Priority Data

Jun. 28, 2005 (JP) ..... 2005-188019

(51) Int. Cl.
*B27B 9/02* (2006.01)

(52) U.S. Cl. ..... 30/376; 30/391

(58) Field of Classification Search ..... 30/374, 30/375, 376, 388, 390, 391
See application file for complete search history.

(56) References Cited

U.S. PATENT DOCUMENTS 3,292,673 A * 12/1966 Gregory ..... 30/377
5,452,515 A * 9/1995 Schilling ..... 30/376
6,202,311 B1 3/2001 Nickels, Jr.
6,601,305 B1 8/2003 Fukuoka
6,681,493 B2 * 1/2004 Mori et al. ..... 30/376
7,290,342 B2 * 11/2007 Hartmann et al. ..... 30/376
2003/0131484 A1 * 7/2003 Yoshida et al. ..... 30/376
2005/0000338 A1 * 1/2005 Wascow ..... 83/473
2008/0115371 A1 * 5/2008 Allen et al. ..... 30/517

* cited by examiner

*Primary Examiner*—Hwei-Siu C Payer
(74) *Attorney, Agent, or Firm*—Oliff & Berridge, PLC

(57) ABSTRACT

It is an object of the invention to provide an effective technique to improve ease of use in adjustment of the bevel angle of a circular saw body of a circular saw. The representative portable circular saw that includes a base, a circular blade, a circular saw body, a pivot, a locking device and a restricting arrangement. The locking device is manually operated by a user to lock the circular saw body to the base in a desired bevel angle position. Besides the locking device, the restricting arrangement prevents free pivotal movement of the circular saw body by holding the circular saw body at a predetermined common bevel angle position. In order to cope with cutting operations both at any desired bevel angle and at the predetermined common bevel angle, the engaging member can be selectively moved between the restricted position in which the engaging member is allowed to contact the engagement portion for allowing the common bevel angle setting and an unrestricted position in which the engaging member is not allowed to contact the engagement portion for allowing the free bevel angle setting by the user without being interfered by the common bevel angle setting arrangement.

14 Claims, 13 Drawing Sheets

FIG. 10
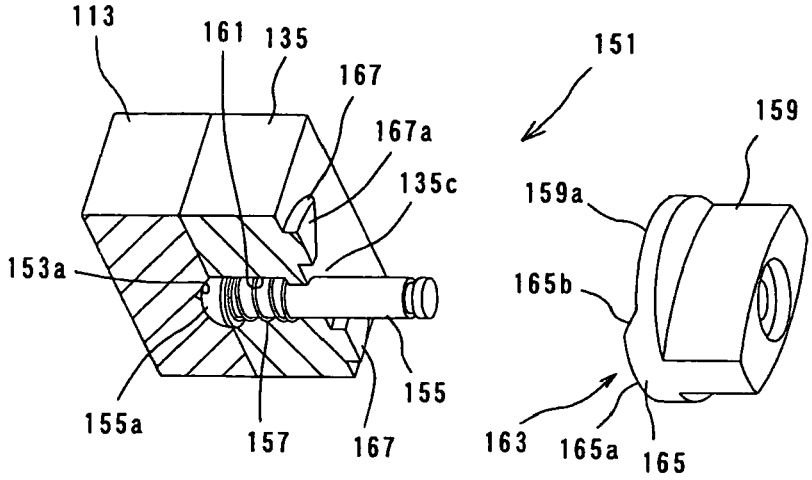
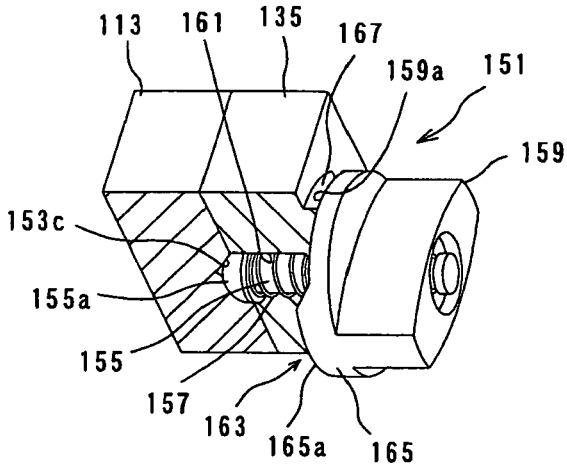
FIG. 11
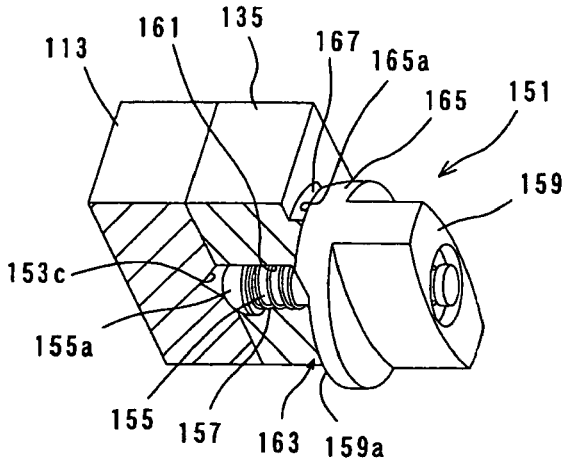
FIG. 12

PORTABLE CIRCULAR SAW

BACKGROUND OF THE INVENTION

1. Field of the Invention

The present invention relates to a portable circular saw and more particularly, to a technique of performing a bevel cutting operation with a saw blade held inclined to a workpiece.

2. Description of the Related Art

A known portable circular saw having a bevel cutting mechanism is disclosed in U.S. Pat. No. 6,202,311. In the known circular saw, a bevel angle of a circular saw body to a base can be adjusted to any angle within a range between a minimum angle or 0° at which the blade is at right angles to the base and a maximum angle (for example, about 50°). In addition, a restricting arrangement is provided to temporarily secure the bevel angle of the circular saw body to common bevel angles of e.g. 45° that are frequently selected by an user of the circular saw for cutting operation. With this restricting arrangement, the circular saw body can be readily secured to a common bevel angle.

The known restricting arrangement is configured such that a spring biased ball formed on a circular saw body-side member is engaged in a spherical recess formed on a base side member and thereby restricts the bevel angle of the circular saw body to a common bevel angle. Therefore, the user of the circular saw may freely select and fix the desired bevel angle without respect to the common bevel angle, while the user may use the common bevel angle which is automatically set via an engagement of the ball and the recess of the restricting arrangement. On the other hand, due to providing such automatically settable common bevel angle, fine adjustment of the bevel angle in the vicinity of the common bevel angle is quite difficult because in such region close to the common bevel angle, the ball tends to engage with the recess and may hinder the fine adjustment of the bevel angle.

SUMMARY OF THE INVENTION

Accordingly, it is an object of the invention to provide an effective technique to improve ease of use in adjustment of the bevel angle of a circular saw body of a circular saw.

The object is achieved by a representative portable circular saw that includes a base, a circular blade, a circular saw body, a pivot, a locking device and a restricting arrangement. The circular blade performs a cutting work by rotation. The circular saw body houses the blade. The pivot connects the circular saw body to the base. Thus, the circular saw body pivots in a direction crossing a cutting direction of the blade with respect to the base. The pivot allows bevel angle adjustment between a minimum bevel angle and a maximum bevel angle with respect to the base of the circular saw body. The locking device is manually operated by a user to lock the circular saw body to the base in a desired bevel angle position between the minimum bevel angle and the maximum bevel angle after the user places the circular saw body in the desired position by pivoting the circular saw body around the pivot. The "minimum bevel angle" is typically an angle of 0° at which the circular saw body is at right angles to the base. Therefore, the bevel angle increases as the circular saw body approaches to a position parallel to the base. On the other hand, the maximum bevel angle is set to an arbitrary angle.

The restricting arrangement prevents free pivotal movement of the circular saw body by holding the circular saw body at a predetermined common bevel angle position defined between the minimum bevel angle and the maximum bevel angle, when the circular saw body is pivoted around the pivot and reaches the common bevel angle position. The common bevel angle position is defined by a specific bevel angle of the circular saw body with respect to the base, which is frequently selected by the user of the circular saw in a cutting operation. For example, bevel angle of 22.5° and/or 45° is very often selected by the user in order for an oblique cutting. Therefore, easy lock system of the circular saw body at such frequently selected bevel angle position is desired by the user, while the circular saw body can be locked at any desired bevel angle position by tightening the screw.

For such easy lock (interlocutory lock) of the circular saw body with respect to the common bevel angle position, the restricting arrangement includes an engagement portion and an engaging member. The engagement portion is provided in one of the circular saw body and the base. On the other hand, the engaging member is provided in the other of the circular saw body and the base. The engaging member contacts with the engagement portion when the circular saw body is pivoted in a direction to increase or decrease the bevel angle with respect to the base. As a result, the bevel angle of the circular saw body can be readily adjusted to the common bevel angle and the circular saw body is easily held at the common bevel angle position.

In view of the above, it is desirable to provide two ways of cutting operation with respect to the bevel angle of the circular saw blade. One is a cutting operation at the predetermined common bevel angle position such as 45 degree. The other is a cutting operation at a desired bevel angle position between the maximum and minimum bevel angles manually selected by the user. In this connection, if the circular saw body is automatically locked at the predetermined common bevel angle position, it may interfere (hinder) the bevel angle setting work of the user at the desired bevel angle position. Therefore, in order to avoid such problem, the engaging member can be selectively moved between the restricted position in which the engaging member is allowed to contact the engagement portion for allowing the common bevel angle setting and an unrestricted position in which the engaging member is not allowed to contact the engagement portion for allowing the free bevel angle setting by the user without being interfered by the common bevel angle setting arrangement.

Preferably, a plurality of common bevel angles may be provided between the minimum bevel angle and the maximum bevel angle. For that, a plurality of engagement portions may be provided in one of the circular saw body and the base. The engagement portions may preferably be assigned to the respective common bevel angle positions. On the other hand, the engaging member may be provided in the other of the circular saw body and the base. The engaging member may exclusively contact with any one of the engagement portions selected by the user to hold the circular saw body to any one common bevel angle position selected by the user. Further, the engaging member may be manually moved away to an unrestricted position in which the engaging member is allowed to contact with none of the engagement portions.

Other objects, features and advantages of the present invention will be readily understood after reading the following detailed description together with the accompanying drawings and the claims.

BRIEF DESCRIPTION OF THE DRAWINGS

FIG. 10 is a sectional perspective view of a stopper arrangement, with a handle shown disassembled therefrom.

FIG. 11 is a sectional perspective view of the stopper arrangement, with a stop pin placed in a restricted position.

FIG. 12 is a sectional perspective view of the stopper arrangement, with the stop pin placed in an unrestricted position.

DETAILED DESCRIPTION OF THE INVENTION

Each of the additional features and method steps disclosed above and below may be utilized separately or in conjunction with other features and method steps to provide and manufacture improved portable circular saws and method for using such circular saws and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

FIRST REPRESENTATIVE EMBODIMENT

Figure 1:
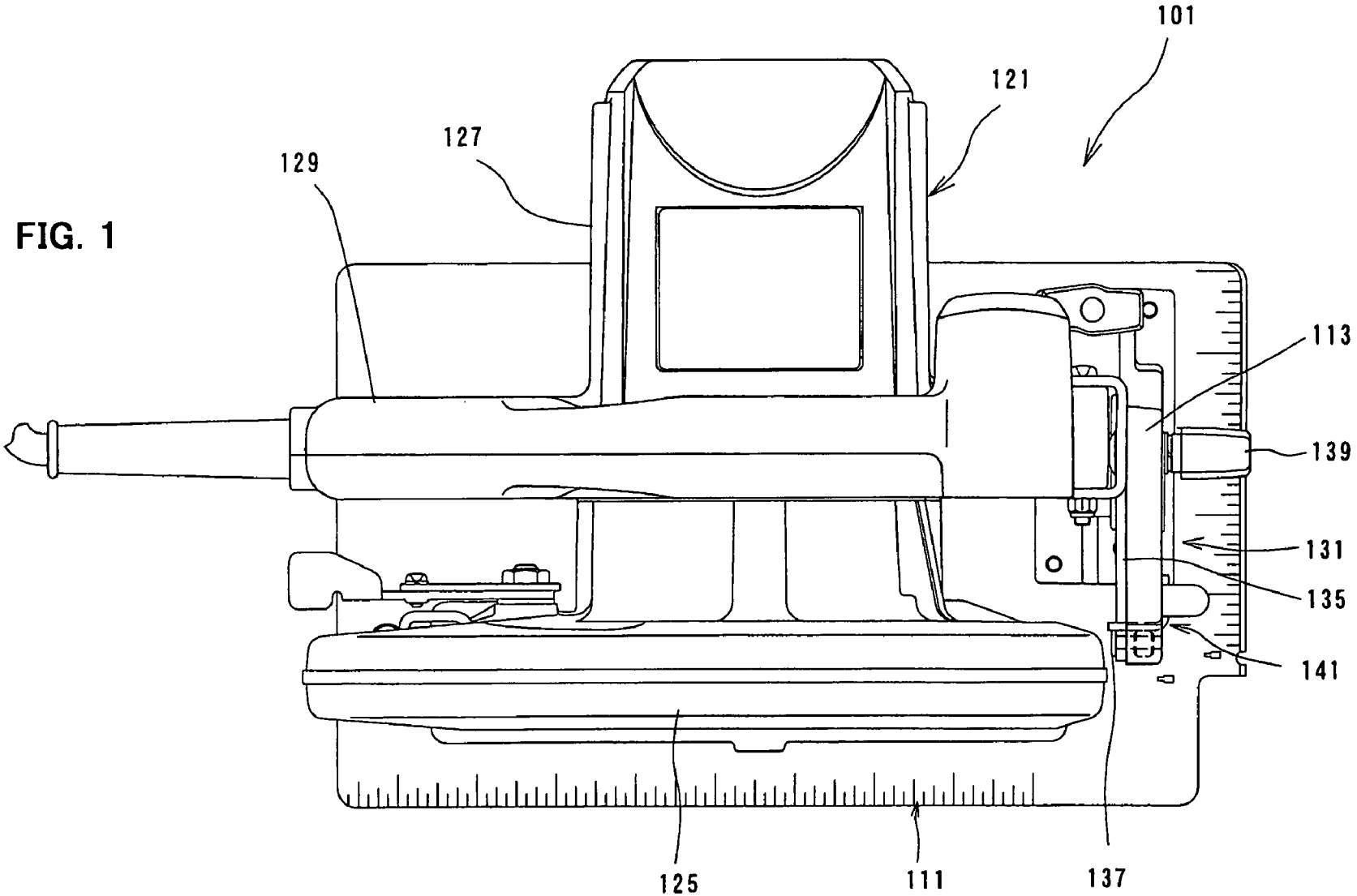
FIG. 1 is a plan view showing an entire circular saw according to a first embodiment of this invention.
Figure 2:
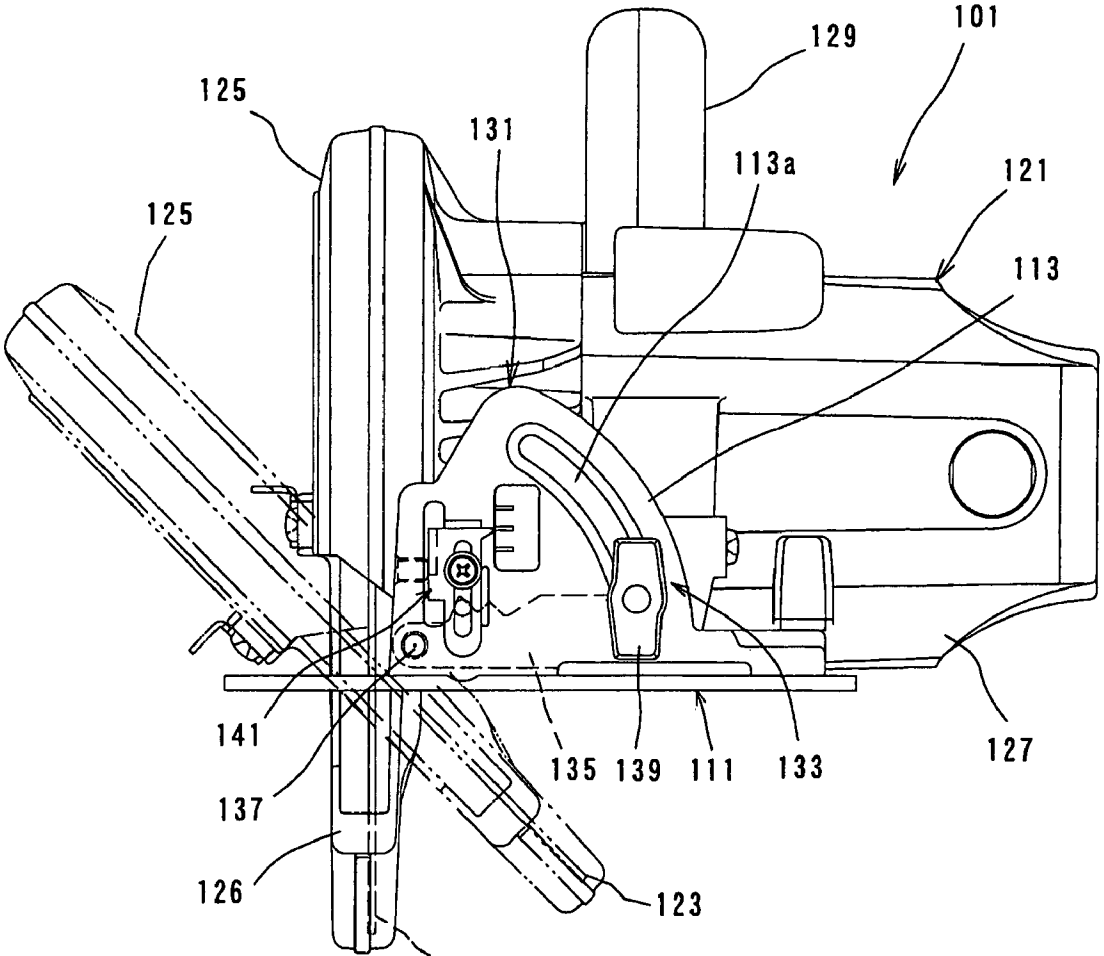
FIG. 2 is a front view of the entire circular saw.
Figure 3:
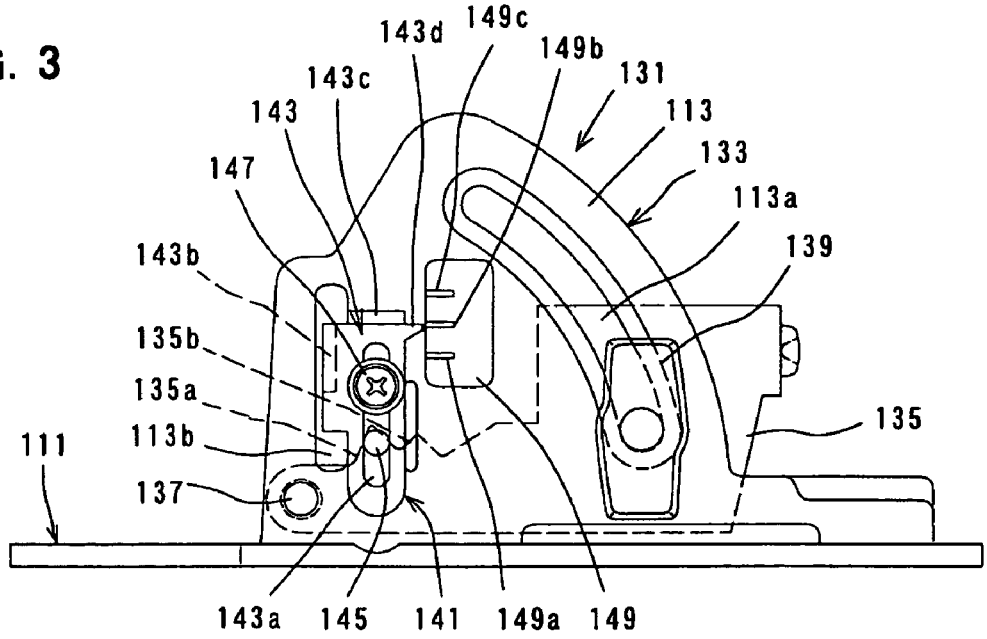
FIG. 3 shows bevel angle adjustment of the circular saw body, particularly showing the state adjusted to a right angle.

A first embodiment of the present invention will be explained with reference to the drawings. FIG. 1 is a plan view showing an entire circular saw 101 according to this embodiment. FIG. 2 is a front view of the entire circular saw 101. FIGS. 3 to 6 show bevel angle adjustment of the circular saw body in enlarged view. FIG. 7 shows a stopper arrangement for restricting the circular saw body to a common bevel angle position. As shown in FIGS. 1 and 2, the circular saw 101 according to this embodiment includes a base 111 which can be placed in use on a workpiece (not shown), and a circular saw body 121 connected to the base 111.

The circular saw body 121 includes a blade 123, a blade case 125 that covers substantially the upper half of the blade 123, a motor housing 127 that houses a driving motor (not shown) for driving the blade 123, and a handgrip 129 held by a user to operate the circular saw 101. The blade 123 is a feature that corresponds to the "circular saw blade" in this invention. A safety cover 126 is pivotally attached to the blade case 125 and covers the lower half of the blade 123. The lower edge portion of the blade 123 including the safety cover 126 protrudes from the underside of the base 111 through an opening of the base 111.

In cutting operation of a workpiece, when the front end (right end as viewed in FIG. 1) of the base 111 is placed on the workpiece and moved forward (rightward as viewed in FIG. 1), the workpiece pushes the front end of the safety cover 126, so that the safety cover 126 retracts and is housed within the blade case 125. The longitudinal direction of the circular saw body 121 corresponds to the cutting direction. The handgrip 129 is integrally formed on the upper portion of the motor housing 127 and has a trigger switch (not shown) operated to start and stop the driving motor.

A bevel cutting mechanism 131 for performing a cutting operation with the blade 123 held inclined to the workpiece will now be explained with reference to FIGS. 3 to 6. The bevel cutting mechanism 131 includes a bevel angle adjusting mechanism 133 that adjusts a bevel angle of the circular saw body 121 to the base 111 and a stopper arrangement 141 that restricts the circular saw body 121 to common bevel angle positions. The common bevel angle position is defined as a position that is frequently selected by a user for performing a cutting operation to the workpiece. The stopper arrangement 141 is a feature that corresponds to the "restricting arrangement" in this invention.

The bevel angle adjusting mechanism 133 includes an angular guide 113 mounted on the base 111, an angular plate 135 mounted on the circular saw body 121, apivot 137 about which the circular saw body 121 is pivoted by operation of the user so as to be inclined to the base 111, and a lock screw 139 that is operated by the user to lock the circular saw body 121 at the adjusted bevel angle position. The lock screw 139 is a feature that corresponds to the "locking device" in this invention. The angular guide 113 as a base side member extends vertically from the front and rear end portions of the upper surface of the base 111. The front angular guide 113 is shown in FIG. 1, but the rear angular guide 113 is not shown. The angular plate 135 as a saw body side member is fixedly mounted to the front and rear end portions of the circular saw body 121. The front angular plate 135 is shown in FIG. 1, but the rear angular plate 135 is not shown. The angular plate 135 is pivotally connected to the angular guide 113 via the pivot 137. The axial direction of the pivot 137 coincides with the cutting direction of the blade 123 or the longitudinal direction of the circular saw body 121. Therefore, the direction of pivotal movement of the circular saw body 121 crosses the cutting direction of the blade 123.

An arcuate guide groove 113*a* is formed in the front angular guide 113 and has a shape of an arc centering on the pivot 137. The lock screw 139 is inserted through the guide groove 113*a* from the front surface side of the angular guide 113 and screwed into the angular plate 135 disposed in surface contact with the rear surface of the angular guide 113. The angular plate 135 is locked to the angular guide 113 by tightening the lock screw 139, and the lock is released by loosening the lock screw 139. Therefore, in the state in which the lock screw 139 is loosened, the bevel angle of the circular saw body 121 or the bevel angle of the blade 123 to the base 111 can be adjusted to any desired angle by rotating the circular saw body 121 about the pivot 137 (inclining it leftward as viewed from the front of the circular saw 101 as shown by phantom line in FIG. 2). After such bevel angle adjustment, the circular saw body 121 can be locked at the desired bevel angle selected by the user by tightening the lock screw 139. In this manner, the circular saw 101 is provided for a bevel cutting operation which is performed with the blade inclined leftward as viewed from the front of the circular saw 101 (see FIG. 2). The bevel angle adjustment of the circular saw body 121 can be made with the aid of a bevel angle indicator (not shown) disposed between the angular guide 113 and the angular plate 135.

The guide groove 113*a* serves as a stopper for defining the setting range of the bevel angle of the circular saw body 121 to the underside of the base 111 (the surface to be placed on the workpiece). Specifically, the bevel angle is at the minimum (in the position shown by solid line in FIG. 2 and the position shown in FIG. 3) when the lock screw 139 that moves together with the angular plate 135 contacts one end (lower end as viewed in the drawings) of the guide groove 113*a* in the extending direction (in the direction of the length of arc). The bevel angle is at the maximum (in the position shown in FIG. 6; for example, 56°) when the lock screw 139 contacts the other end (upper end as viewed in the drawings). The minimum bevel angle is 0° at which the blade 123 is at right angles to the base 111 (in the state shown in FIG. 3). However, allowing for machining accuracy or a clearance actually created between parts in assembling, the guide groove 113*a* is dimensioned such that the circular saw body 121 is allowed to incline slightly over a right angle (0°) in the minimum bevel angle (right angle) position. Further, the circular saw body 121 can be adjusted to a normal right-angle position by fine adjustment means (not shown).

Figure 4:
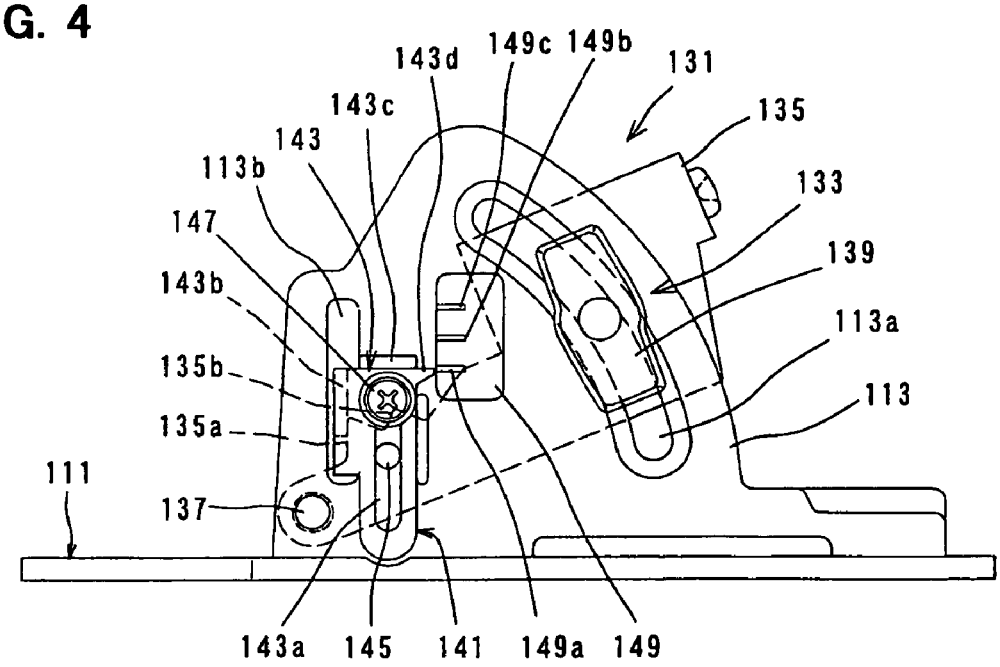
FIG. 4 shows bevel angle adjustment of the circular saw body, particularly showing the state adjusted to a first common bevel angle.
Figure 5:
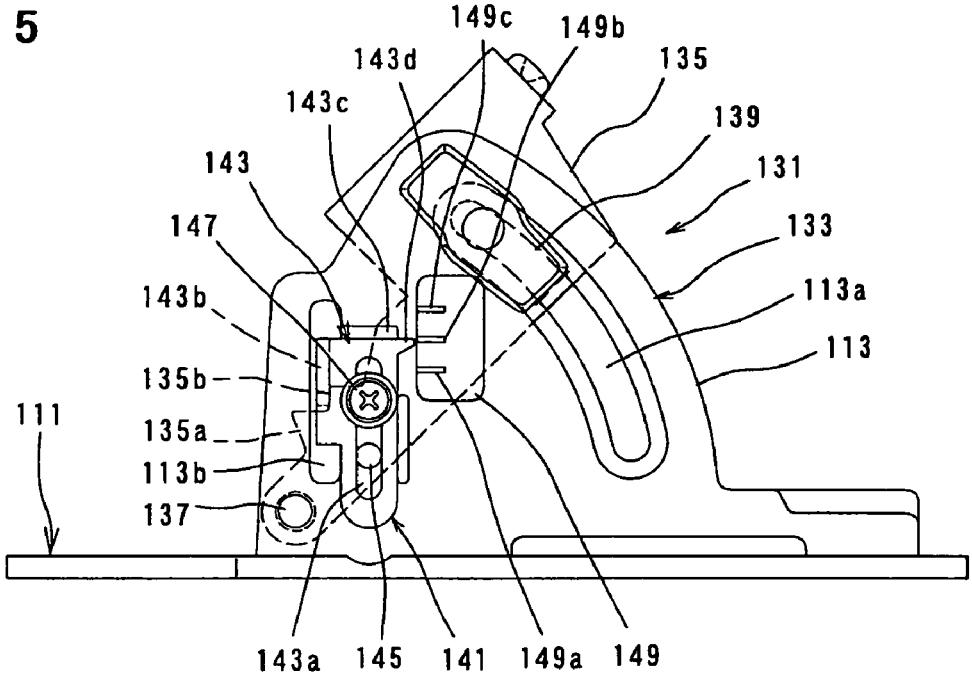
FIG. 5 shows bevel angle adjustment of the circular saw body, particularly showing the state adjusted to a second common bevel angle.

The stopper arrangement 141 provides a stop for specified bevel angles or common bevel angles of the circular saw body 121 that are frequently selected by the user for a cutting operation. The stopper arrangement 141 provides a stop at a bevel angle shown in FIG. 4 (e.g. 22.5°) and at a bevel angle shown in FIG. 5 (e.g. 45°). The bevel angles shown in FIGS. 4 and 5 are hereinafter referred to as "a first common bevel angle" and "a second common bevel angle", respectively. The stopper arrangement 141 includes a contact portion 135*a* for the first common bevel angle and a contact portion 135*b* for the second common bevel angle which are provided on the circular saw body 121 side, and a stopper member 143 that can be engaged with the contact portions 135*a*, 135*b*. The contact portions 135*a*, 135*b* are defined by steps and respectively have contact surfaces with respect to an engagement with the stopper member 143. The stopper member 143 and the contact portions 135*a*, 135*b* are features that respectively correspond to the "engaging member" and the "engagement portions" in this invention.

The stopper member 143 is mounted to a guide pin 145 and a setscrew 147 via a guide groove 143*a* for position change and can linearly move in the vertical direction via the guide pin 145 and the setscrew 147 serving as guide members. The guide pin 145 and the setscrew 147 are disposed on the front surface of the angular guide 113 at a predetermined distance in the vertical direction from each other. The stopper member 143 includes a stopper element 143*b*, an operating knob 143*c*, and an angle pointer 143*d*. The stopper element 143*b* protrudes from the rear surface of the angular guide 113 through an opening 113*b* formed in the angular guide 113. The stopper element 143*b* has a contact surface that enables the facial contact with the contact portion 135*a* for the first common bevel angle or the contact portion 135*b* for the second common bevel angle when the angular plate 135 is pivoted about the pivot 137.

A scale plate 149 is disposed on the front surface of the angular guide 113. The scale plate 149 has a scale 149*a* for indicating the first common bevel angle of the circular saw body 121, a scale 149*b* for indicating the second common bevel angle, and a scale 149*c* for indicating the maximum bevel angle, from down to up in this order. Therefore, the stopper member 143 can be appropriately moved in the vertical direction and positioned by operating the operating knob 143*c* with the user's finger, such that the angle pointer 143*d* can be selectively pointed to any one of the scale 149*a* for the first common bevel angle, the scale 149*b* for the second common bevel angle, and the scale 149*c* for the maximum bevel angle.

The contact portion 135*a* for the first common bevel angle and the contact portion 135*b* for the second common bevel angle are formed on the angular plate 135 and serve to restrict the bevel angle of the circular saw body 121 by contact with the stopper element 143*b* of the stopper member 143. Either one of the two contact portions 135*a*, 135*b* contacts the stopper element 143*b* of the stopper member 143 when the circular saw body 121 is pivoted from the minimum bevel angle (right-angle) side to the maximum bevel angle side. Specifically, the contact portion 135*a* for the first common bevel angle contacts the stopper element 143*b* when the stopper member 143 is positioned at the scale 149*a* for the first common bevel angle, while the contact portion 135*b* for the second common bevel angle contacts the stopper element 143*b* when the stopper member 143 is positioned at the scale 149*b* for the second common bevel angle. Thus, the circular saw body 121 is restrictively secured to the first common bevel angle position or the second common bevel angle position.

Figure 6:
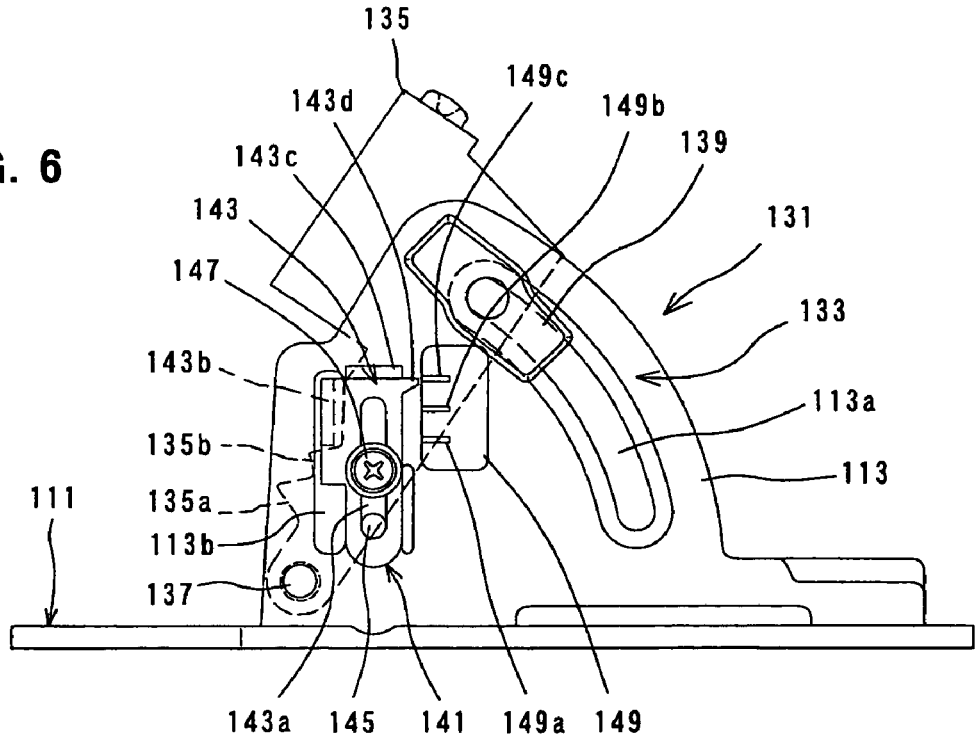
FIG. 6 shows bevel angle adjustment of the circular saw body, particularly showing the state adjusted to a maximum bevel angle.
Figure 7:
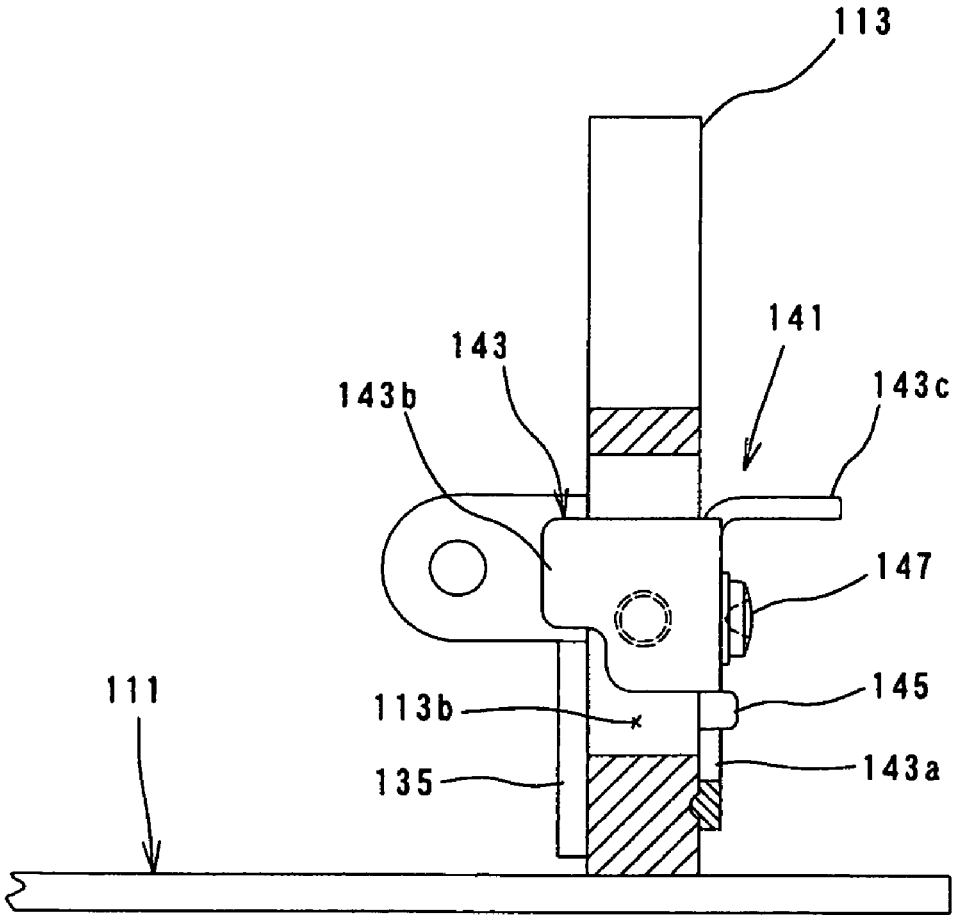
FIG. 7 shows a stopper arrangement for restricting a common bevel angle.

Further, when the stopper member 143 is moved to the upper most position in which the lower end of the position adjusting guide groove 143*a* contacts the guide pin 145, or the position in which the angle pointer 143*c* points to the scale 149*c* for the maximum bevel angle (the position as shown in FIG. 6), even if the circular saw body 121 is pivoted to the maximum bevel angle position (in which the lock screw 139 contacts the other end of the guide groove 113*a*), the stopper member 143 does not contact either of the contact portions 135*a*, 135*b*. Specifically, when the stopper member 143 is positioned either in the first common bevel angle position or the second common bevel angle position, the stopper member 143 is in a restricted position in which the stopper element 143*b* contacts the contact portion 135*a* or 135*b* of the angular plate 135, so that the bevel angle of the circular saw body 121 is restrictively secured to the first common bevel angle or the second common bevel angle. On the other hand, when the stopper member 143 is positioned in the maximum bevel angle position, the stopper member 143 is in an unrestricted position in which the stopper element 143*b* cannot contact either of the contact portions 135*a*, 135*b*. Thus, the stopper member 143 is allowed to move between the restricted positions for the first and second common bevel angles or between the restricted positions and the unrestricted position.

In order to retain the stopper member 143 in a moved position, a frictional resistance is provided between sliding contact surfaces of the front surface of the angular guide 113 and the rear surface of the stopper member 143. When the stopper member 143 is moved by a force exceeding this frictional force, the stopper member 143 is allowed to move between the restricted positions or between the restricted positions and the unrestricted position. In this case, preferably, the frictional resistance can be adjusted by appropriately adjusting the tightening force of the setscrew 147.

The circular saw 101 according to this embodiment is thus constructed. For right-angle cutting which is most frequently selected by the user for a cutting operation, the user loosens the lock screw 139 and pivots the circular saw body 121 around the pivot 137 until the lock screw 139 contacts the one end (lower end) of the guide groove 113*a*. Thus, right-angle cutting is allowed with the circular saw body 121 held at a bevel angle of a right angle (0°). In this case, as described above, if an accurate squareness is required, an accurate adjustment can be made by using a fine adjustment means. For bevel cutting using the first common bevel angle, as shown in FIG. 4, the user moves the stopper member 143 to the position in which the angle pointer 143*d* points to the scale 149*a* for the first common bevel angle. In this state, when the user loosens the lock screw 139 and pivots the circular saw body 121 about the pivot 137 in the direction that increases the bevel angle, the contact portion 135*a* for the first common bevel angle on the angular plate 135 contacts the stopper element 143*b* of the stopper member 143. Thus, the circular saw body 121 is restrictively secured (held) to the first common bevel angle position. In this state, the lock screw 139 is tightened to lock the circular saw body 121 to the base 111. Thus, the bevel cutting at the first common bevel angle is allowed.

For bevel cutting using the second common bevel angle, as shown in FIG. 5, the user moves the stopper member 143 to the position in which the angle pointer 143*d* points to the scale 149*b* for the second common bevel angle. In this state, when the user loosens the lock screw 139 and pivots the circular saw body 121 about the pivot 137 in the direction that increases the bevel angle, the contact portion 135*b* for the second common bevel angle on the angular plate 135 contacts the stopper element 143*b* of the stopper member 143. Thus, the circular saw body 121 is secured (held) to the second common bevel angle position. In this state, the lock screw 139 is tightened to lock the circular saw body 121 to the base 111. Thus, the bevel cutting at the second common bevel angle is allowed. Further, for bevel cutting using the maximum bevel angle, as shown in FIG. 6, the user moves the stopper member 143 to the position in which the angle pointer 143*d* points to the scale 149*c* for the maximum bevel angle. In this state, when the user loosens the lock screw 139 and pivots the circular saw body 121 about the pivot 137 in the direction that increases the bevel angle, the lock screw 139 contacts the other end of the guide groove 113*a*. Thus, the circular saw body 121 is restrictively secured to the maximum bevel angle position. In this state, the lock screw 139 is tightened to lock the circular saw body 121 to the base 111. Thus, the bevel cutting at the maximum bevel angle is allowed.

Thus, according to the first embodiment, the bevel angle can be adjusted by pivoting the circular saw body 121 between the minimum bevel angle and the maximum bevel angle. Further, the position of the stopper member 143 can be selectively changed between a position corresponding to the first common bevel angle and a position corresponding to the second common bevel angle, so that the bevel angle of the circular saw body 121 can be readily set to the first common bevel angle or the second common bevel angle.

In adjustment of the bevel angle to the first common bevel angle or the second common bevel angle, a normal bevel angle may not be obtained due to dimensional errors caused during manufacturing the stopper arrangement 141 which consists of a plurality of component parts, or errors caused during assembly. Or, even if the normal bevel angle is obtained, the bevel angle in the neighborhood of the common bevel angle may be desired to be used. For these reasons, in some cases, a fine adjustment of the bevel angle of the circular saw body 121 is desired to be made in the neighborhood of the first and second common bevel angles without suffering restriction of the stopper member 143. In such a case, as described above, by moving the stopper member 143 to the unrestricted position in which the contact portions 135*a*, 135*b* of the angular plate 135 cannot contact the stopper element 143*b* of the stopper member 143, or the upper most position in which the lower end of the position adjusting guide groove 143*a* contacts the guide pin 145, fine adjustment of the bevel angle of the circular saw body 121 can be readily and accurately made without suffering restriction by the stopper member 143.

Thus, according to this embodiment, the circular saw 101 can be prevented from the bevel angle restriction of the stopper member 143 as necessary. Therefore, it is made possible to select between the bevel angle adjustment using the stopper member 143 and the bevel angle adjustment without using the stopper member 143. Thus, the circular saw 101 can be provided with increased ease of use in adjustment of the bevel angle of the circular saw body 121.

According to the embodiment, the stopper member 143 restricts the bevel angle of the circular saw body 121 when the circular saw body 121 pivots about the pivot 137 in the direction that increases the bevel angle. On the contrary, it may be changed to the construction in which the bevel angle restriction is made when the circular saw body 121 pivots from the maximum bevel angle side to the minimum bevel angle side. In this case, the bevel angle restriction by the stopper member 143 is removed by moving the stopper member 143 to the minimum bevel angle side. Further, according to the this embodiment, the stopper member 143 is provided on the angular guide 113 and the contact portions 135*a*, 135*b* are provided on the angular plate 135. On the contrary, the contact portions 135*a*, 135*b* may be provided on the angular guide 113 and the stopper member 143 on the angular plate 135.

SECOND REPRESENTATIVE EMBODIMENT

A second embodiment of the present invention is now explained with reference to FIGS. 8 to 14. The second embodiment relates to a modification to the stopper arrangement 141 for restricting the common bevel angle of the circular saw body 121 in the bevel cutting mechanism 131 of the first embodiment. A stopper arrangement 151 for restricting the common bevel angle according to the second embodiment is capable of restricting the bevel angle of the circular saw body 121 in any direction of pivotal movement of the circular saw body 121. Except for this stopper arrangement 151, the second embodiment has the same construction as the first embodiment and therefore, the other components or elements in the second embodiment substantially identical to those in the first embodiment are given like numerals as in the first embodiment and will not be described or only briefly described. The stopper arrangement 151 is a feature that corresponds to the "restricting arrangement" in this invention.

Figure 8:
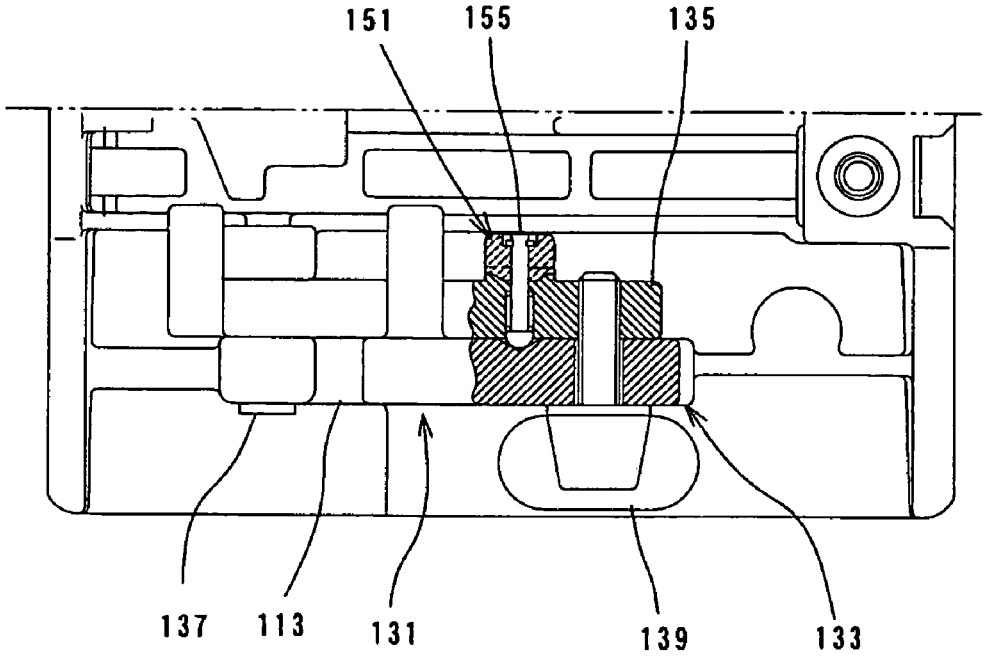
FIG. 8 is a sectional plan view showing a bevel cutting mechanism according to a second embodiment of this invention.
Figure 9:
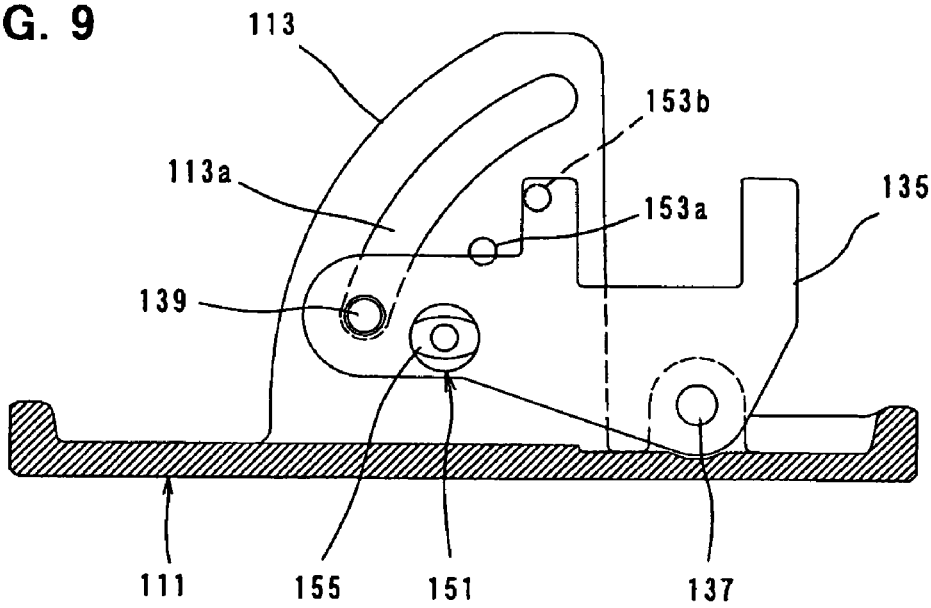
FIG. 9 shows the bevel cutting mechanism as viewed from the rear side.

FIG. 8 is a sectional plan view of the bevel cutting mechanism 131. FIG. 9 shows the bevel cutting mechanism 131 as viewed from the rear side. As shown in FIGS. 8 and 9, in the state in which the lock of the lock screw 139 is released, the bevel angle of the circular saw body 121 to the base 111 can be adjusted to a desired angle between the minimum bevel angle and the maximum bevel angle by rotating the circular saw body 121 about the pivot 137 together with the angular plate 135. After such bevel angle adjustment, the circular saw body 121 can be locked at the desired bevel angle by tightening the lock screw 139.

As shown in FIGS. 10 to 12, the stopper arrangement 151 according to this embodiment includes two engagement recesses 153*a*, 153*b* (see FIG. 9) that serve to restrictively secure the first and second common bevel angles of the circular saw body 121, a stop pin 155 that can move toward and away from the engagement recesses 153*a*, 153*b*, a biasing spring 157 that normally biases the stop pin 155 toward the engagement recesses 153*a*, 153*b*, and a handle 159 for operating the pin. The engagement recesses 153*a*, 153*b* and the stop pin 155 are features that respectively correspond to the "engagement portions" and the "engaging member" in this invention. Further, the biasing spring 157 is a feature that corresponds to the "biasing member" in this invention.

The engagement recess 153*a* for the first common bevel angle and the engagement recess 153*b* for the second common bevel angle are formed in the rear surface of the angular guide 113 (which is a base side member) and are conically shaped having a V-shaped section. The stop pin 155 is inserted into a guide hole 161 formed through the angular plate 135 (which is a circular saw body side member). The stop pin 155 can move in its axial direction and rotate around its axis. A spherical portion 155*a* having a generally semispherical shape is formed on one end of the stop pin 155 which faces with the engagement recesses 153*a*, 153*b*. The spherical portion 155*a* is fitted in the engagement recesses 153*a*, 153*b*, so that the stop pin 155 is engaged with the engagement recesses 153*a*, 153*b*. The biasing spring 157 is elastically disposed within the guide hole 161 between the spherical portion 155*a* of the stop pin 155 and a stepped surface of the guide hole 161. The biasing spring 157 biases the spherical portion 155*a* in a direction that causes the spherical portion 155*a* to protrude through the guide hole 161 or to engage the engagement recesses 153*a*, 153*b*. As shown in FIG. 9, the engagement recesses 153*a*, 153*b* are located on the path of travel of the stop pin 155 which pivots around the pivot 137 together with the angular plate 135.

The other end of the stop pin 155 protrudes from the rear surface of the angular plate 135 through the guide hole 161, and the handle 159 is fixedly mounted on the protruding portion. The stop pin 155 can be moved between a restricted position (shown in FIG. 11) and an unrestricted position (shown in FIG. 12) by operating the handle 159. In the restricted position, the spherical portion 155*a* protrudes through the guide hole 161 and engages the engagement recess 153*a* or 153*b*, so that the circular saw body 121 is locked in the first or second common bevel angle position and prevented from free pivotal movement. In the unrestricted position, the spherical portion 155*a* is retracted into the guide hole 161 and disengaged from the engagement recess 153*a* or 153*b*, so that the restriction of the bevel angle of the circular saw body 121 is removed.

A cam 163 is provided between the handle 159 and the angular plate 135 and serves to allow smooth movement of the stop pin 155 between the restricted position and the unrestricted position for position changing. As shown in FIGS. 10 to 12, the cam 163 includes two angle cams 165 formed in the front surface of the handle 159 and two angle cams 167 formed in the rear surface of the angular plate 135. The cams 165 on the handle 159 side are spaced apart 180° from each other around the axis of the handle 159 and have a predetermined height protruding from a front surface 159*a* of the handle 159 in the axial direction. Further, each of the cams 165 on the handle 159 side has a flat surface 165*a* on the protruding end and an inclined surface 165*b* that contiguously connects the flat surface 165*a* to the front surface 159*a* of the handle 159.

The cams 167 on the angular plate 135 side are provided around the guide hole 161 and spaced apart 180° from each other so as to correspond to the cams 165 on the handle 159 side. The cams 167 also have a predetermined height protruding from a rear surface 135*c* of the angular plate 135 in the axial direction. Further, the protruding end of each of the cams 167 on the angular plate 135 side comprises a flat surface 167*a*. When the cams 165 of the handle 159 engage the rear surface 135*c* of the angular plate 135, the spherical portion 155*a* of the stop pin 155 protrudes through the guide hole 161 and engages the engagement recess 153*a* or 153*b*. On the other hand, when the cams 165 of the handle 159 engage (ride on) the cams 167 of the angular plate 135, the spherical portion 155*a* of the stop pin 155 is retracted into the guide hole 161 and disengaged from the engagement recess 153*a* or 153*b*.

Figure 13C:
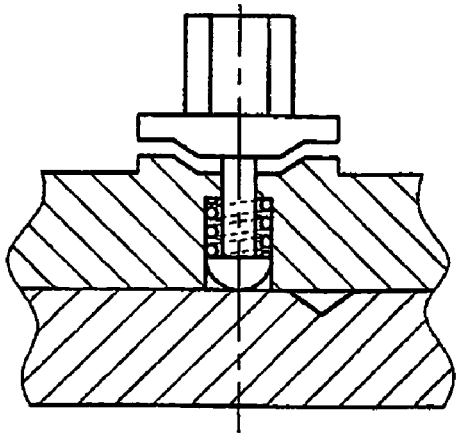
FIG. 13 illustrates movement of the stop pin in the state in which the stop pin is in the restricted position.
Figure 13B:
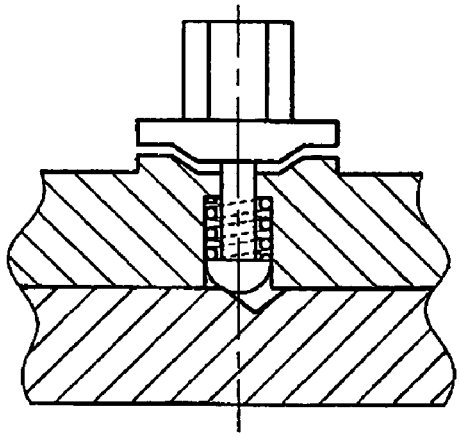
Figure 13A:
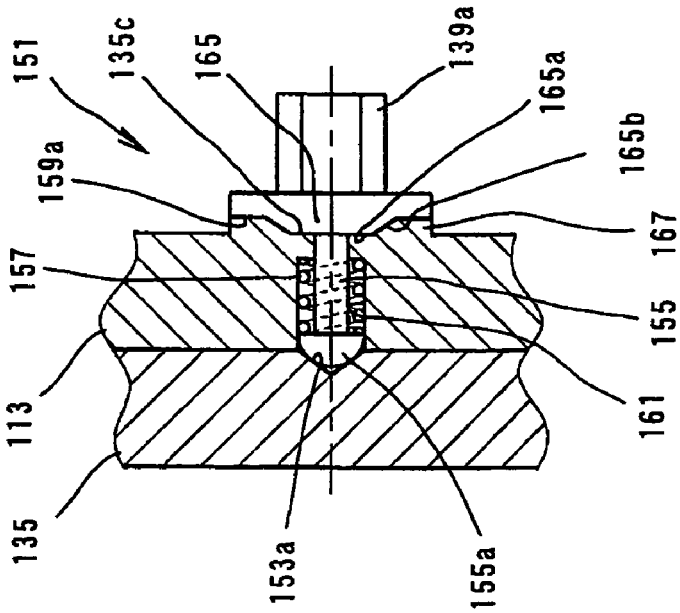

Operation of the stopper arrangement 151 according to this embodiment is explained with reference to FIGS. 13 and 14. FIG. 13 shows the state in which the cams 165 of the handle 159 are in engagement with the rear surface 135*c* of the angular plate 135 and the stop pin 155 is in the restricted position in which the bevel angle of the circular saw body 121 is secured. When the stop pin 155 reaches a position corresponding, for example, to the engagement recess 153*a* for the first common bevel angle by pivoting the angular plate 135 about the pivot 137 together with the circular saw body 121, as shown in FIG. 13(A), the spherical portion 155*a* of the spring biased stop pin 155 engages the engagement recess 153*a*. Thus, the circular saw body 121 is restrictively secured in the first common bevel angle position. In this state, the lock screw 139 is tightened to lock the circular saw body 121, so that the cutting operation can be performed at the first common bevel angle.

The biasing spring 157 has a sufficiently large biasing force to match with the moment acting upon the circular saw body 121 around the pivot 137 by its own weight. On the other hand, when a force larger than the biasing force of the biasing spring 157 is applied around the pivot 137 to the circular saw body 121, as shown in FIGS. 13(B) and 13(C), the spherical portion 155*a* is disengaged from the engagement recess 153*a* or 153*b*, which allows the pivotal movement of the circular saw body 121. Therefore, in order to change the bevel angle of the circular saw body 121 from the first common bevel angle to the second common bevel angle, the lock screw 139 is loosened and the circular saw body 121 is pivoted against the biasing force of the biasing spring 157. Thus, not only the adjustment between the first common bevel angle and the second common bevel angle, but the adjustment between the minimum bevel angle and the maximum bevel angle of the circular saw body 121 can be readily made.

A fine adjustment of the bevel angle may be further needed around the first common bevel angle or the second common bevel angle for the reasons as described above. In some cases, however, with a bevel angle restricting construction using the engagement between the engagement recesses 153*a*, 153*b* and the spherical portion 155*a* of the spring biased stop pin 155 as described above, such a fine adjustment may possibly become difficult. Specifically, as shown in FIG. 13(B), in the state in which the spherical portion 155*a* is located within the engagement recess 153*a* or 153*b*, the biasing force of the biasing spring 157 acts upon the inclined surface of the engagement recess 153*a* or 153*b*. Therefore, it becomes difficult to make a fine adjustment by setting the bevel angle of the circular saw body 121 and locking it in such an inclined position.

Figure 14C:
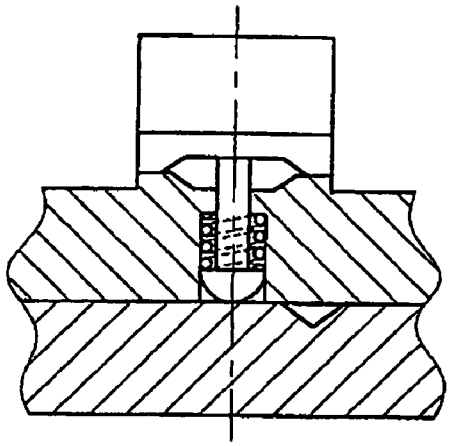
FIG. 14 illustrates fine adjustment of a bevel angle in the state in which the stop pin is in the unrestricted position.
Figure 14B:
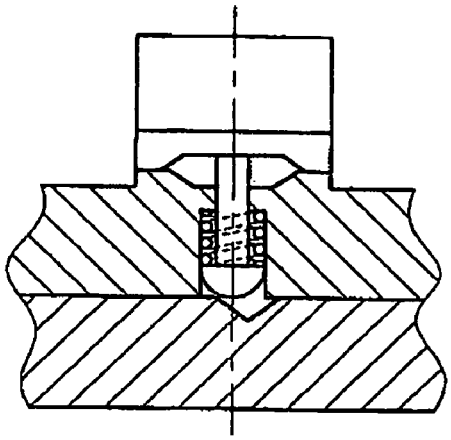
Figure 14A:
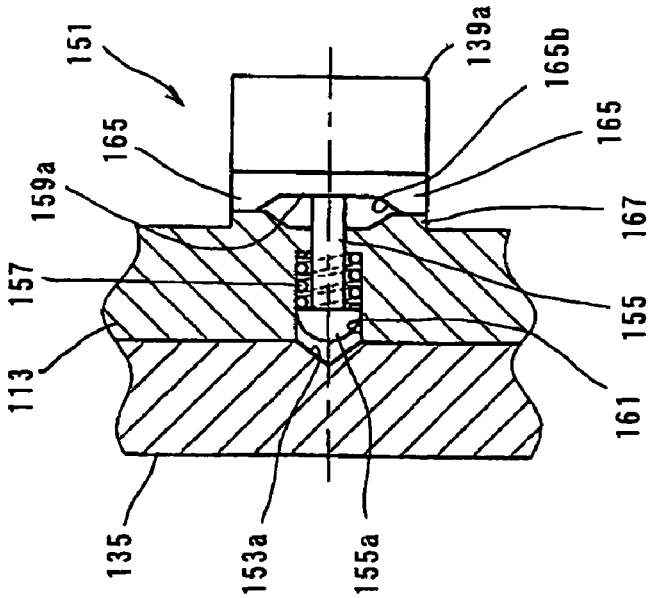
Figure 15:
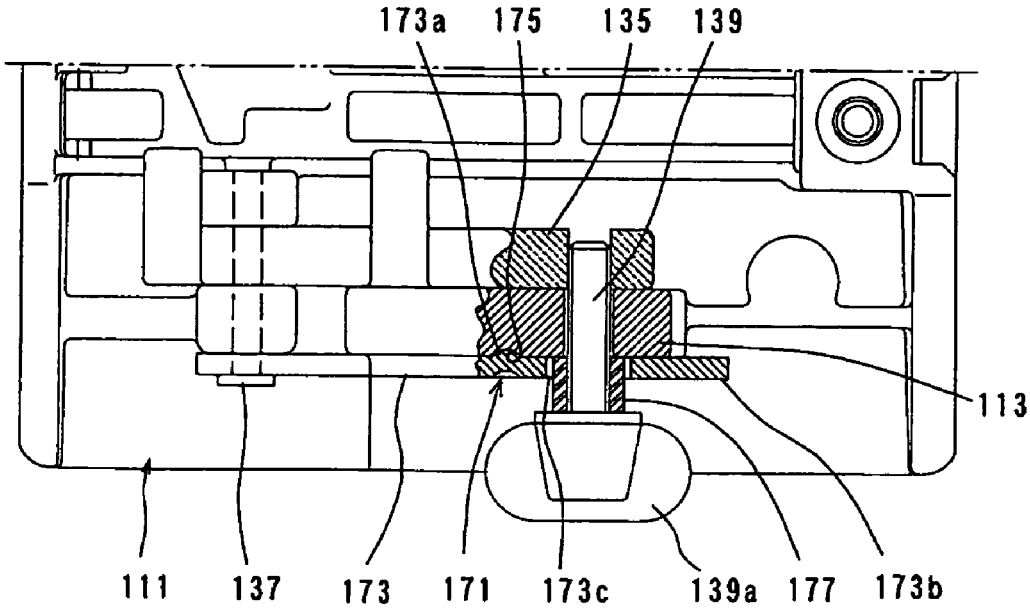
FIG. 15 is a sectional plan view showing a bevel cutting mechanism according to a third embodiment of this invention, with a stop lever of a stopper arrangement shown in the restricted position.
Figure 16:
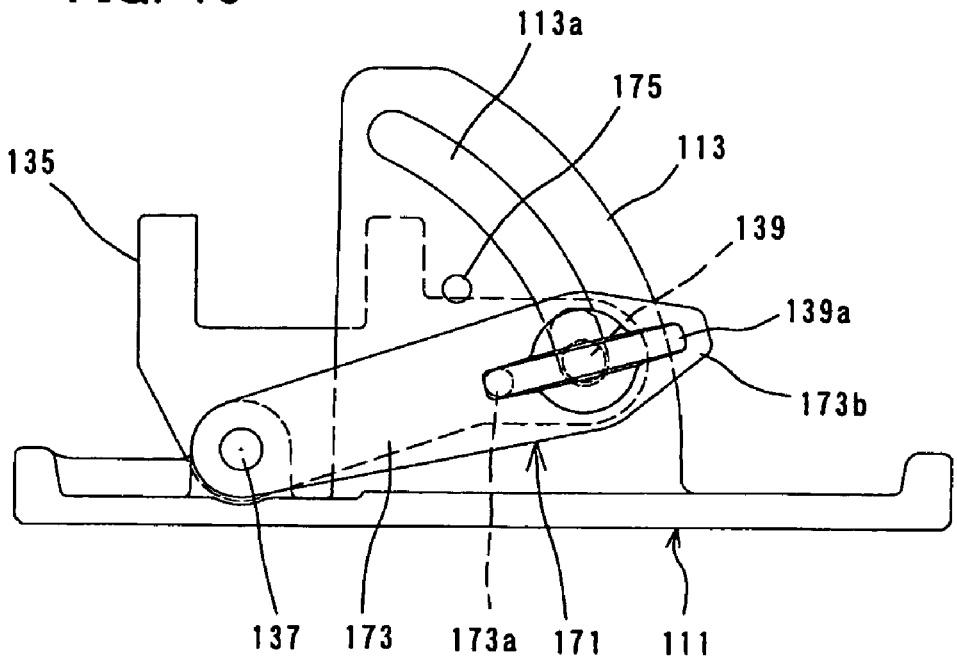
FIG. 16 is a front view showing a bevel cutting mechanism.
Figure 17:
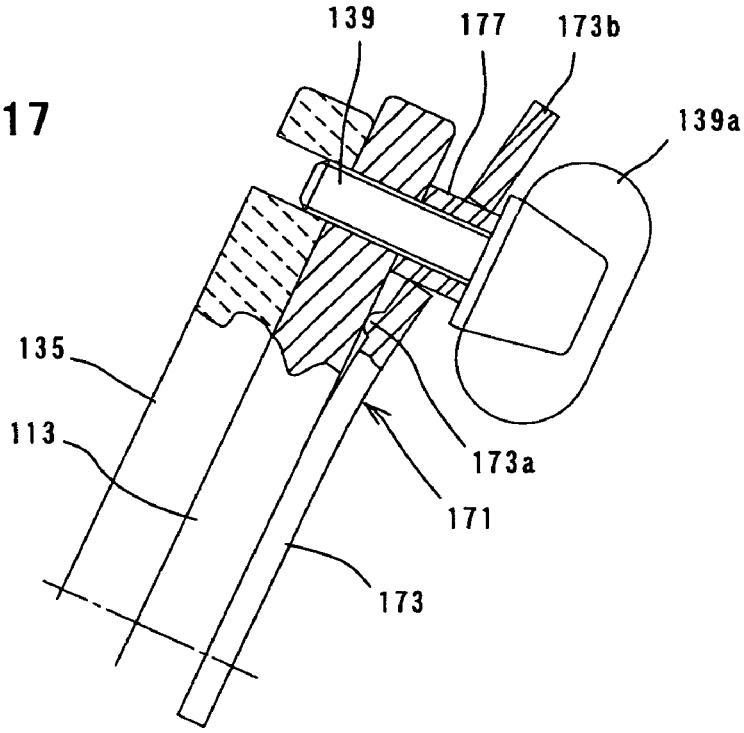
FIG. 17 shows the stop lever in the state in which the circular saw body is placed in an angular position other than a common bevel angle position.
Figure 18:
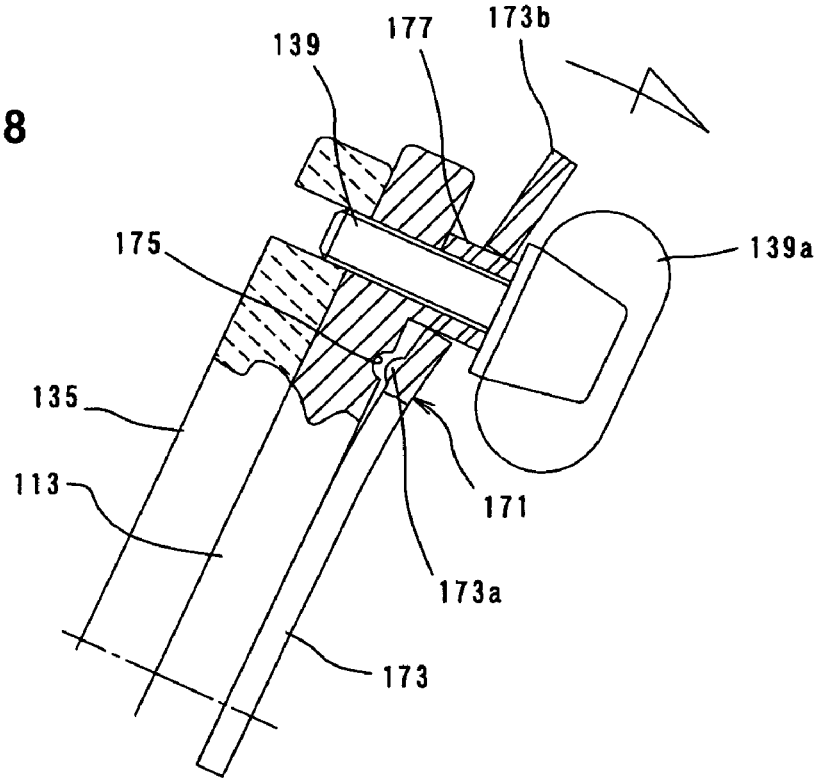
FIG. 18 shows the state in which the stop lever is in the unrestricted position.
Figure 19:
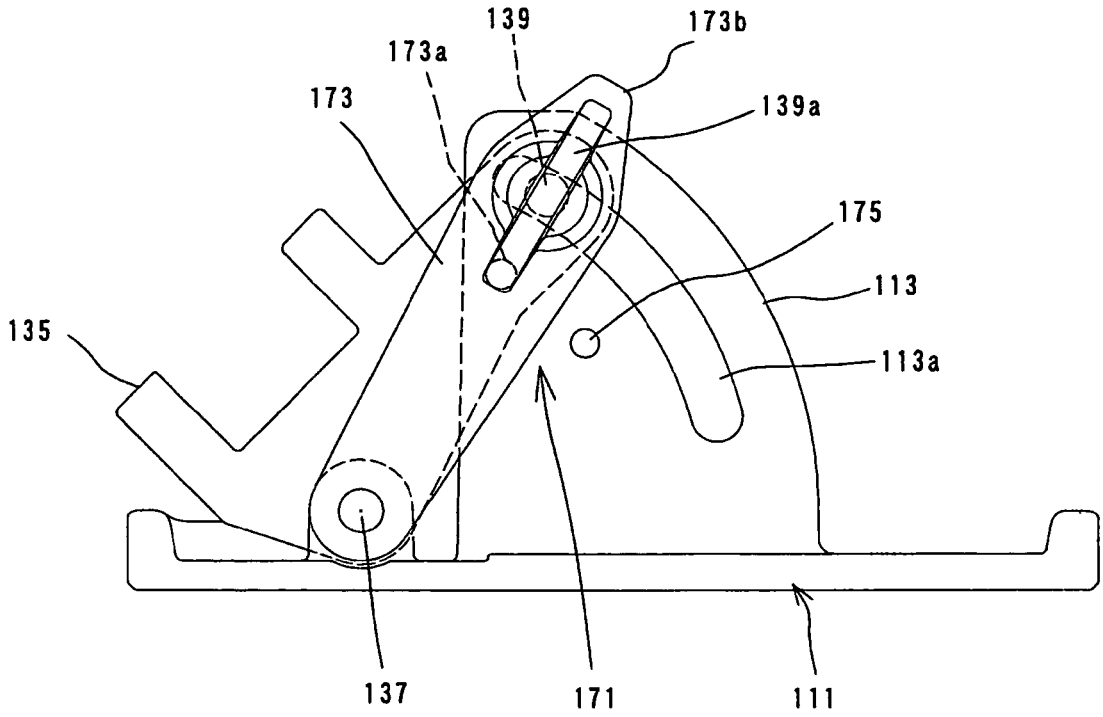
FIG. 19 shows the state in which the circular saw body is restricted to a first maximum bevel angle position.

In this connection, as shown in FIG. 14, the stop pin 155 can be switched to the unrestricted position in which the spherical portion 155*a* of the stop pin 155 is disengaged from the engagement recess 153*a* or 153*b*. Specifically, the angle cams 165 of the handle 159 are engaged with the angle cams 167 of the angular plate 135, so that the stop pin 155 can be moved to the unrestricted position and held in the position. Therefore, the bevel angle can be adjusted in the state in which the restriction of the bevel angle of the circular saw body 121 by the stop pin 155 is removed. As a result, fine adjustment of the bevel angle can be readily and accurately made without respect to whether the range of the fine adjustment is inside or outside the region of engagement between the engagement recess 153*a* or 153*b* and the spherical portion 155*a*.

Further, each of the angle cams 165 of the handle 159 is contiguous to the front surface 159*a* of the handle 159 via the inclined surface 165*b*. Therefore, simply by turning the handle 159, the angle cams 165 can ride on the angle cams 167 of the angular plate 135 via the inclined surface 165*b*, which allows the stop pin 155 to move linearly in the axial direction. Thus, the stop pin 155 can be readily switched from the restricted position to the unrestricted position. Further, the switching between the restricted position and the unrestricted position can be made within a small operating range, so that such cam can be effectively arranged within a limited space. Further, with the construction in which the engagement between the angle cams 165 of the handle 159 and the angle cams 167 of the angular plate 135 is made on the respective flat surfaces 165*a*, 167*a* (see FIG. 10), the stop pin 155 can be reliably held in the unrestricted position.

The embodiment may also be constructed such that the bevel angle is secured in one position. Further, the stop pin 155 may also be provided on the angular guide 113 and the engagement recesses 153*a*, 153*b* on the angular plate 135.

THIRD REPRESENTATIVE EMBODIMENT

A third representative embodiment of the present invention is explained with reference to FIGS. 15 to 22. The third embodiment relates to a modification to the stopper arrangement 151 in the bevel cutting mechanism 131 of the second embodiment. Except for this point, the third embodiment has the same construction as the second embodiment. Therefore, the other components or elements in the third embodiment which are substantially identical to those in the second embodiment are given like numerals as in the second embodiment and will not be described or only briefly described.

As shown in FIGS. 15 to 18, a stopper arrangement 171 for restricting the common bevel angle according to the third embodiment includes a spherical engagement recess 175 and a stop lever 173. The engagement recess 175 is formed in the front surface of the angular guide 113 (which is a base side member), and the stop lever 173 is disposed on the front surface of the angular guide 113 and can pivot around the pivot 137 together with the angular plate 135 (which is a circular saw body side member). The engagement recess 175 and the stop lever 173 are features that respectively correspond to the "engagement portions" and the "engaging member" in this invention. A spherical engagement projection 173*a* is formed on the stop lever 173 at a predetermined distance from the pivot 137 and protrudes to the side of the angular guide 113. The bevel angle of the circular saw body 121 is held to a common bevel angle by engagement between the engagement projection 173*a* and the engagement recess 175 (see FIG. 15). One common bevel angle position is set, for example, at a bevel angle position of 22.5°. When the circular saw body 121 is pivoted to a position other than the common bevel angle position, the engagement projection 173*a* is pushed by the inclined surface of the engagement recess 175. As a result, the stop lever 173 is elastically deformed (warped) away from the front surface of the angular guide 113. Thus, the engagement projection 173*a* is disengaged from the engagement recess 175 and contacts the front surface of the angular guide 113 (see FIG. 17). In this embodiment, one common bevel angle to be held is provided, but a plurality of common bevel angles may be provided.

An operating portion 173*b* is provided on the stop lever 173 and is operated to force the stop lever 173 to be elastically deformed (warped) forward of the angular guide 113. The operating portion 173*b* is defined by the end of the stop lever 173 which protrudes from the outer peripheral edge of the angular guide 113. The stop lever 173 is elastically deformed when the user picks up the operating portion 173*b* by the fingers. As a result, the engagement projection 173*a* is disengaged from the engagement recess 175, so that the restriction of the bevel angle can be removed (see FIG. 18). Specifically, the stop lever 173 can be moved by utilizing its own elastic deformation between the restricted position in which it locks the circular saw body 121 in the common bevel angle position and prevents free pivotal movement of the circular saw body 121 and the unrestricted position in which such restriction is removed. Further, the stop lever 173 is provided with a biasing force in a direction in which the engagement projection 173*a* moves toward the engagement recess 175.

The lock screw 139 serves to lock the circular saw body 121 to the base 111 or release the lock. The lock screw 139 is inserted from the front of the stop lever 173 through a through hole 173*c* formed near the tip end of the stop lever 173 and through the guide groove 113*a* of the angular guide 113 and then screwed into the angular plate 135. Therefore, in the state in which the lock screw 139 is loosened, the stop lever 173 can pivot around the pivot 137 together with the angular plate 135. Further, a spacer 177 is disposed between the angular guide 113 and an operating knob 139*a* of the lock screw 139 and loosely fitted in the through hole 173*c* of the stop lever 173. The spacer 177 provides a space for elastic deformation of the stop lever 173.

Figure 20:
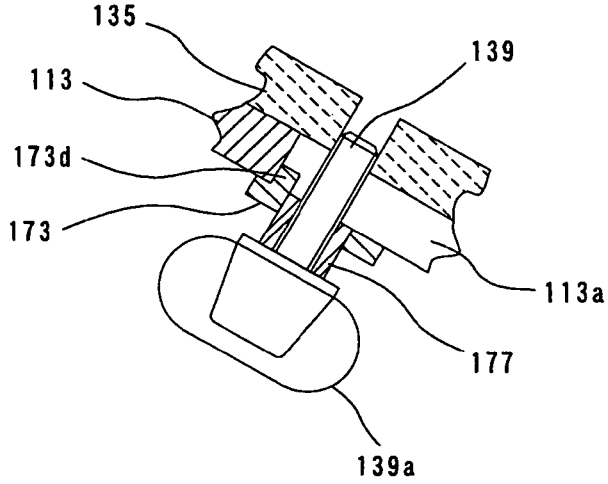
FIG. 20 is a sectional view showing the state in which the circular saw body is restricted to the first maximum bevel angle position.
Figure 21:
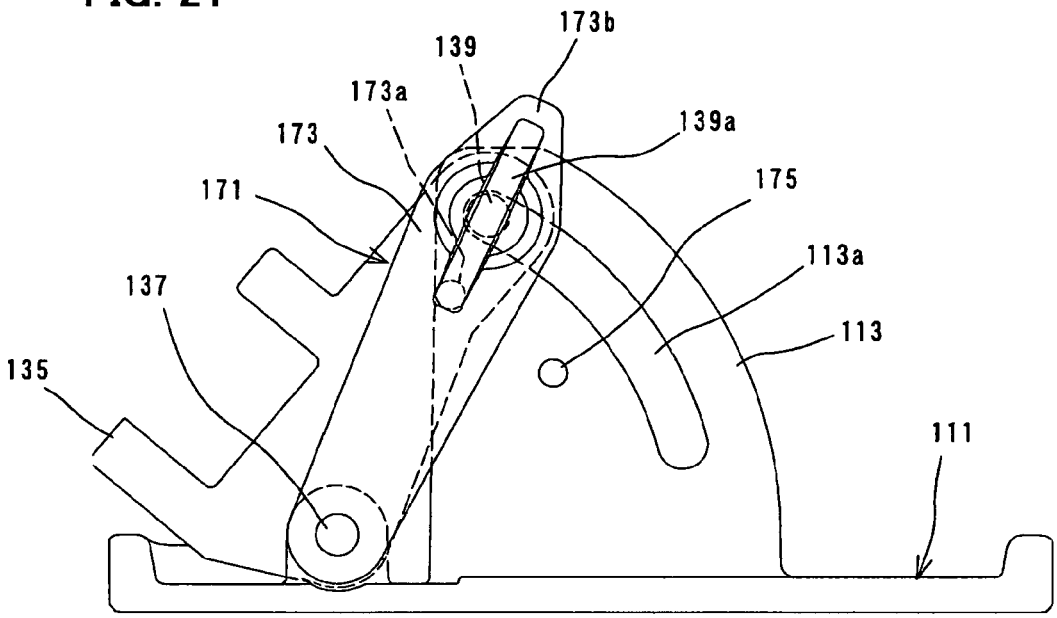
FIG. 21 shows the state in which the circular saw body is restricted to a second maximum bevel angle position.
Figure 22:
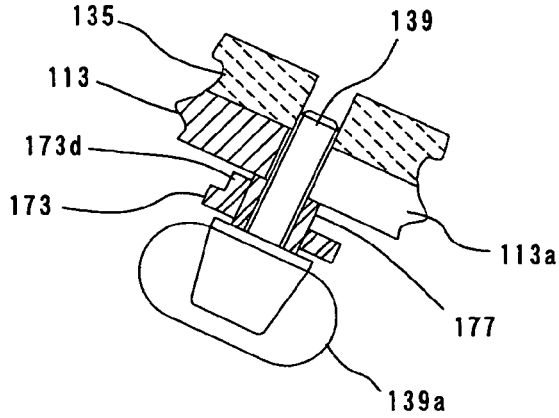
FIG. 22 is a sectional view showing the state in which the circular saw body is restricted to the second maximum bevel angle position.

The stopper arrangement 171 has a function of switching between a first maximum bevel angle position which is frequently used (the position shown in FIG. 19, for example, 45°) and a second maximum bevel angle position of which angle is larger than the first maximum bevel angle (the position shown in FIG. 21, for example, 50°). Specifically, as shown in FIGS. 20 and 22, a stop projection 173*d* is formed on the stop lever 173 and can be engaged in the guide groove 113*a*. When the circular saw body 121 is pivoted about the pivot 137 in the direction that increases the bevel angle, the stop projection 173*d* contacts one end (upper end as viewed in FIG. 19) of the guide groove 113*a*, so that the circular saw body 121 is held to the first maximum bevel angle position (see FIG. 20). When the stop lever 173 is elastically deformed away from the angular guide 113, the stop projection 173*d* is disengaged from the guide groove 113*a*, so that the circular saw body 121 is allowed to move to the second maximum bevel angle position. At this time, the lock screw 139 directly contacts one end (upper end as viewed in FIG. 21) of the guide groove 113*a*, so that the circular saw body 121 is held to the second maximum bevel angle position (see FIG. 22).

When the circular saw body 121 is pivoted around the pivot 137 in the state in which the circular saw body 121 is not locked to the base 111 by the lock screw 139, the engagement projection 173*a* of the stop lever 173 reaches the engagement recess 175 of the angular guide 113. At the same instant, the engagement projection 173*a* is engaged with the engagement recess 175 by the elastic restoring force of the stop lever 173. Thus, the circular saw body 121 is held to the common bevel angle position. In this state, the circular saw body 121 is locked by tightening the lock screw 139, so that the workpiece can be cut at the common bevel angle.

The stop lever 173 is elastically deformed away from the angular guide 113 when the operating portion 173*b* is picked up by the user's fingers. Thus, the engagement projection 173*a* is disengaged from the engagement recess 175, so that the stop lever 173 can be switched to the unrestricted position in which the restriction of the bevel angle is removed. Therefore, when the need arises to make a fine adjustment of the bevel angle of the circular saw body 121 around the common bevel angle, the stop lever 173 can be moved to the unrestricted position, so that the fine adjustment of the bevel angle can be readily made without influence of the stop lever 173. Further, the stop projection 173*d* formed for angle restriction on the stop lever 173 can be engaged in or disengaged from the guide groove 113*a* of the angular guide 113 when the stop lever 173 is elastically deformed by the user. In this manner, the bevel angle of the circular saw body 121 can be readily switched between the first maximum bevel angle and the second maximum bevel angle larger than the first maximum bevel angle.

In the above-descried three embodiments, the engagement recess 175 is provided on the angular guide 113 and the stop lever 173 is provided on the angular plate 135. However, on the contrary, the stop lever 173 may be provided on the angular guide 113 and the engagement recess 175 on the angular plate 135.

DESCRIPTION OF NUMERALS

101 portable circular saw
111 base
113 angular guide
113*a* guide groove
113*b* opening
121 circular saw body
123 blade
125 blade case
126 safety cover
127 motor housing
129 handgrip
131 bevel cutting mechanism
133 bevel angle adjusting mechanism
135 angular plate
135*a* contact portion for the first common bevel angle (engagement portion)
135*b* contact portion for the second common bevel angle (engagement portion)
135*c* rear surface
137 pivot
139 lock screw (locking device)
139*a* operating knob
141 stopper arrangement (restricting arrangement)
143 stopper member (engaging member)
143*a* guide groove for position change
143*b* stopper element
143*c* operating knob
143*d* angle pointer
145 guide pin
147 setscrew
149 scale plate
149*a* scale for the first common bevel angle
149*b* scale for the second common bevel angle
149*c* scale for the maximum bevel angle
151 stopper arrangement (restricting arrangement)
153*a* engagement recess for the first common bevel angle (engagement portion)
153*b* engagement recess for the second common bevel angle (engagement portion)
155 stop pin (engaging member)
155*a* spherical surface
157 biasing spring (biasing member)
159 handle
159*a* front surface
161 guide hole
163 cam
165 angular cam
165*a* flat surface
165*b* inclined surface
167 angular cam
167*a* flat surface
171 stopper arrangement (restricting arrangement)
173 stop lever (engaging member)
173*a* engagement projection
173*b* operating portion
173*c* through hole
173*d* stop projection
175 engagement recess (engagement portion)
177 spacer

We claim:

1. A portable circular saw comprising:

a base, a circular blade performing a cutting work by rotation, a circular saw body housing the blade, a pivot that connects the circular saw body to the base such that the circular saw body pivots in a direction crossing a cutting direction of the blade with respect to the base, the pivot allowing bevel angle adjustment of the circular saw body between a minimum bevel angle and a maximum bevel angle with respect to the base of the circular saw, a locking device manually operated by a user to lock the circular saw body to the base in a desired bevel angle position between the minimum bevel angle and the maximum bevel angle after the user places the circular saw body in the desired position by pivoting the circular saw body around the pivot and a restricting arrangement that prevents free pivotal movement of the circular saw body by holding the circular saw body at a predetermined common bevel angle position defined between the minimum bevel angle and the maximum bevel angle, when the circular saw body is pivoted around the pivot and reaches the common bevel angle position, the restricting arrangement further comprising:

an engagement portion provided on one of the circular saw body and the base, and an engaging member provided in the other of the circular saw body and the base, the engaging member contacting with the engagement portion when the circular saw body is pivoted in a direction to increase or decrease the bevel angle with respect to the base, thereby holding the circular saw body at the common bevel angle position, wherein the engaging member is selectively moved between a restricted position in which the engaging member is allowed to contact the engagement portion and an unrestricted position in which the engaging member is not allowed to contact the engagement portion such that, when in the unrestricted position, the engaging member does not contact the engagement portion even when a desired bevel angle position is selected that corresponds to a particular common bevel angle position of the circular saw body.

2. The portable circular saw as defined in claim 1, wherein a plurality of common bevel angles are provided between the minimum bevel angle and the maximum bevel angle, a plurality of engagement portions are provided in one of the circular saw body and the base, the engagement portions being assigned to the respective common bevel angle positions, the engaging member is provided in the other of the circular saw body and the base, the engaging member exclusively contacting with any one of the engagement portions selected by the user to hold the circular saw body to any one common bevel angle position selected by the user, while the engaging member is manually moved to the unrestricted position in which the engaging member is allowed to contact with none of the engagement portions.

3. The circular saw as defined in claim 2, wherein engaging member moves between the restricted position and the unrestricted position in a direction crossing the direction of contact between the engaging member and the engagement portions.

4. The circular saw as defined in claim 3, wherein the engaging member is held in each position by frictional resistance between the engaging member and one of the circular saw body and the base to which the engaging member is disposed.

5. The circular saw as defined in claim 1, wherein the engagement portion and the engaging member respectively comprises contacting surfaces to provide facial contact with each other so as to define the common bevel angle.

6. The circular saw as defined in claim 2, wherein each of the engagement portions is disposed in a different position on a radius of the circular saw body that pivots around the pivot, and the engaging member is selectively engaged with one of the engagements portions to define the respective common bevel angle when the circular saw body pivots around the pivot.

7. The circular saw as defined in claim 6, wherein the engaging member moves in a radial direction of the pivotal movement of the circular saw body around the pivot so that the engaging member selectively and exclusively engages with one of the engagement portions.

8. The circular saw as defined in claim 1, wherein the engaging member linearly moves toward or away from the engagement portion in a direction crossing the direction of pivotal movement of the circular saw body, the engaging member being biased toward the engagement portion such that the engaging member is manually moved away from the restricted position to the unrestricted position against the biasing force exerted to the engaging member.

9. The circular saw as defined in claim 8 further comprising a cam that allows the engaging member to move away from the engagement portion against the biasing force when the engaging member is pivoted around the axis of the engaging member, the cam comprising an inclined surface that guides the engaging member to disengage from the engagement portion and a flat surface that retains the engaging member in a position to which the engaging member is moved.

10. The circular saw as defined in claim 2, wherein the engaging member is defined by a rod or a pin.

11. The circular saw as defined in claim 2, wherein the engagement portions are defined by steps, each step having a contacting surface to selectively contact with the engaging member.

12. The circular saw as defined in claim 2, wherein the engaging member is defined by a projection and the engagement portions are defined by a plurality of recesses.

13. The circular saw as defined in claim 12, wherein the projection is defined by a pin biased by a coil spring disposed around the pin.

14. The circular saw as defined in claim 12 further comprising a lever, wherein the projection is disposed at a free end region of the lever and moves between the restricted and unrestricted positions by resiliently deforming the lever.

* * * * *